United States Patent [19]

Armond

[11] Patent Number: 4,819,933

[45] Date of Patent: Apr. 11, 1989

[54] ALL WEATHER SURFACES

[75] Inventor: Victor J. Armond, Newark, England

[73] Assignee: Fibresand Limited, Nottinghamshire, England

[21] Appl. No.: 32,061

[22] Filed: Mar. 27, 1987

Related U.S. Application Data

[63] Continuation-in-part of Ser. No. 891,877, Jul. 30, 1986.

[30] Foreign Application Priority Data

Dec. 14, 1985 [GB] United Kingdom ..... 8530844
Mar. 13, 1986 [GB] United Kingdom ..... 8606208

[51] Int. Cl.[4] ..... A01N 3/00; A41G 1/00

[52] U.S. Cl. ..... 272/3; 428/17; 428/87; 47/DIG. 9

[58] Field of Search ..... 272/3, 5; 404/17, 27, 404/131, 82; 405/263, 264; 47/33, 57.6, DIG. 9; 428/87, 17, 95, 96; 273/29 A

[56] References Cited

U.S. PATENT DOCUMENTS 3,091,436 5/1963 Finn ..... 47/DIG. 9
3,125,294 3/1964 Lill ..... 47/DIG. 9
3,334,556 8/1967 Owen ..... 404/31
3,797,690 3/1974 Taylor et al. ..... 47/9 X
3,995,079 11/1976 Haas, Jr. ..... 428/87 X
4,044,179 8/1977 Haas, Jr. ..... 273/29 A X
4,369,054 1/1983 Shinholster et al. ..... 47/9 X
4,389,435 6/1983 Haas, Jr. ..... 428/87 X
4,396,653 8/1983 Tomarin ..... 428/87 X
4,497,853 2/1985 Tomarin ..... 428/17
4,637,942 1/1987 Tomarin ..... 428/17

FOREIGN PATENT DOCUMENTS 2442809 8/1980 France ..... 47/56
200475 5/1983 German Democratic Rep. .... 272/3

*Primary Examiner*—David A. Scherbel
*Assistant Examiner*—Richard E. Chilcot, Jr.
*Attorney, Agent, or Firm*—Cohn, Powell & Hind

[57] ABSTRACT

A surface suitable for equestrian and other use such as ball games is formed using a sand mixture which comprises a selected sand within which is distributed in a homogeneous and randomly oriented manner a relatively small percentage by weight of straight (uncrimped) polymeric fibres, the fibres serving to hold the sand together under the weight of the horses hooves or players feet or other users such as wheeled vehicles or implements.

20 Claims, No Drawings

ALL WEATHER SURFACES

FIELD OF THE INVENTION

The present invention relates to all weather surfaces and more particularly to surfaces suitable for equestrian usage and also all weather surfaces which are particularly suitable for ball games in which body contact occurs between players or between players and the playing surface.

BACKGROUND OF THE INVENTION

The natural surface for most sporting events, particularly horse jumping, is grass. This is acceptable for large areas such as race courses where the usage is low and the grass therefore has time to recover between race meetings. Where the surface is used more extensively for example in training areas grass particularly in the autumn and winter period becomes worn and muddy patches appear. These patches form dusty hard surfaces in dry conditions. In the summer turf can become hard and this may lead to an unacceptable incidence of leg injuries. This also applies to frosty weather. Thus for an exercise and/or all weather race track area, grass, especially that which is growing in natural soil, is not acceptable.

As an alternative to grass a number of artificial surfaces have been used. A first known surface comprises natural wood fibre and this when new provides a good surface. It is however a natural material and therefore deteriorates with age. Thus it has to be replaced and since it is fairly expensive the replacement cost is high. A second known surface comprises finely chopped P.V.C. often from used electrical cable insulation material. This produces a good surface but if laid deeply the surface is rather loose and the cost of the material is very high. A third known surface comprises ashes from power stations. The ashes provide a surface which drains readily when newly laid in wet weather but in dry conditions the surface produces dust and becomes compacted becoming hard especially after prolonged use. An alternative surface is silica sand which provides a good surface in wet weather conditions but in dry weather conditions the sand provides an extremely difficult surface for both jumping and landing particularly for an equestrian practise ring. The principal problem of silica sand is that it lacks cohesion therefore providing a surface which is described as riding too deep and loose.

The natural surface for most games playing is grass. The damage to the turf and soil structure which is caused by normal usage is offset by natural regeneration, but when usage is intensive the scale of damage can exceed the rate of such recovery. This is particularly pronounced in areas such as goal mouths and centre circles where the turf can be totally destroyed and the soil severely compacted. In wet weather this means mud; in dry weather the surface is hard and bumpy.

As an alternative to grass a number of artificial surfaces have been used. A first known surface, commonly known as hard porous, comprises water bound grit/-sand/clay mixtures of differing proportions, normally laid over a drainage layer of coarser material. This surface provides inadequate cushioning and is too abrasive. The surface material also becomes destructured and therefore loses permeability. In dry weather dust is a problem.

A second known surface comprises a synthetic material designed to imitate real turf. This may be laid on soil or on a drainage layer of sand or other material. This synthetic turf may or may not be infilled by a top dressing of sand. Such a surface is expensive to install and has insufficient resilience for falling players. Maintenance and repairs are difficult and costly.

A third known surface comprises a layer of fibres which are joined together in a loose pattern, laid in a bed of sand which in turn may be laid on a drainage layer of other material. Maintenance and repairs are difficult and costly. Play characteristics are poor.

A fourth known surface comprises a layer of sand or granular material bound by bitumastic or similar material. Such a surface has insufficient resilience, is too abrasive and is difficult and costly to repair and maintain.

SUMMARY OF THE INVENTION

It is an object of the present invention to provide an all weather surface which is acceptable in both wet and dry conditions for all types of practice arenas and events.

The present invention therefore provides an all weather surface for equestrian events and usage, and for games playing, comprising a layer of material laid on top of a soil or a prepared drainage base, the material comprising a mixture of sand and synthetic fibres.

Preferably the sand particles are in the range from 100 to 1000 um and the fibres are in the range from 25 to 75 mm in length. A selected range of fibre length is between 35 to 50 mm.

Preferably the layer is between 75 mm and 150 mm thick. The diameter of fibres is 50 to 150 denier. A preferred value is in the region of 100 denier and a depth of layer of 100 mm.

The fibres are preferably of any polymeric or inorganic material but preferably polypropylene in an uncrimped form commonly referred to as straight staple fibre. The percentage of fibre in the mixture is preferably in the region of 0.1 to 0.9% by weight with a preferred value of 0.45% and a preferred range of 0.4 to 0.5%.

The sand may be silica sand, or a sand bonded with water activated clay or a sand bonded with an organic liquid activated clay.

When a silica sand mixture is used the percentage of fibres preferred is in the range from 0.3 to 0.6% by weight. For a sand bonded with water activated clay or an organic liquid activated clay the percentages of fibres preferred are in the ranges from 0.2 to 0.5% and 0.1 to 0.4% by weight respectively.

The fibres may be coloured to conform to the colour of the sand and thereby being substantially invisible in use.

DESCRIPTION OF THE PREFERRED EMBODIMENTS

There are three main types of sand which are suitable for riding surfaces namely silica sand, sand bonded with water activated clay and sand bonded with an organic fluid activated clay. Each of these types of sand, when combined with the fibres in a substantially homogenous manner produces a good surface for a horse riding practise area but each has its own characteristic making it more suitable for certain conditions. Each type has been tried in practical tests as follows:

1. Silica Sand

This is a sand which is relatively clean is clay free and is a well graded sand produced by a wet classification method. In practice when mixed with the fibre the mixture is suitable for both indoor and outdoor use. The mixture requires a relatively high fibre content and a preferred range is between 0.4 to 0.5% by weight of fibre. This is because the sand prior to mixing with the fibre is relatively free to move and therefore requires a relatively high fibre content to effect the desired result.

The silica sand and fibre mixture is particularly suited to outdoor use in high rainfall areas because it drains freely, especially if laid on a well draining sub layer. It may be used indoors where it benefits from regular spraying with water to produce a good surface for riding. Alternatively a water retaining agent such as calcium chloride may be applied to the sand to assist in retaining the moisture within the sand.

2. Sand bonded with water activated clay

This is a sand in which the sand particles are coated with a water activated clay which imparts a degree of cohesive strength to the sand, the extent of the cohesive strength being dependent on the relative amounts of clay and water.

When sprayed with water during use this sand with the fibre mixed therein retains the water. Thus, it is suitable for indoor use where a single wetting operation will be sufficient to maintain the surface in a desired condition for a relatively long period of time. Dependent on the amount of clay the mixture may not be particularly suited to outdoor use especially in "wet" climates. In dry climates however, the water retentive property of the added clay may be beneficial in reducing the amount of spraying necessary if a heavier surface is required. Because of the characteristic of the sand the amount of fibre included does not need to be as much as in the silica sand mixture, and a preferred range of 0.2 to 0.5% by weight is found to be most practical.

3. Sand bonded with an organic liquid activated clay

This is a sand in which the particles are coated with an organo-clay complex—that is activated by an organic chemical such as oil. The degree of cohesive strength produced in the sand is dependent upon the amounts of organo-clay complex and oil.

This type of clay when combined with the fibre as a mixture is not substantially affected by water. Thus, the mixture is suitable for both indoor and outdoor use. When used indoors it does not require watering and when used outside rain will not substantially affect the surface because the water will drain through or run off but will not cause the sand to bind more closely together. In climates where frost is common this mixture is particularly advantageous because it does not freeze in the same manner as the sand with water activated clay or the silica sand. Dependent on the oil selected the freezing point will normally be below minus twenty degrees Centigrade and therefore when used outside any practise area can be made greater use of in cold weather without risk of damage to, for example, horses due to frozen ground.

A disadvantage with the sand bonded with an organic liquid activated clay is in the cost, since this type of mixture will be more expensive than the silica sand or sand with water activated clay.

Because the sand is bonded with a clay the fibre content required for a good surface is not as high as for silica sand and a preferred range of from 0.1 to 0.4% by weight is found to give good practical results.

The sand and fibre need to be mixed to a substantially homogenous mixture to thereby distribute the fibre evenly and randomly throughout the sand. Though a low density ratio by weight is used the fibre being of a significantly lower bulk density is present in a random dispersion throughout the mixture.

The all weather surface is prepared in a first example by digging out turf and top soil to a depth of approximately 10 cm (100 mm) layer from a turf surface. A mixture of sand and fibre is used to replace the removed soil. A greater depth of soil may be removed particularly if the drainage characteristics are poor and the lower layer may be replaced with a drainage base comprising clean crushed rock or gravel of appropriate size laid to an appropriate thickness in accordance with normal drainage engineering design rules.

The mixture is prepared by taking a quantity (usually several tons) of sand which is in a fairly moist condition and mixing into the sand a quantity of polypropylene fibres which are 35 to 50 mm in length. The sand is preferably selected to be between 100 to 1000 um in particle size with particles of rounded to sub-angular shape and the fibres are mixed for example in a high intensity mixer of the contra rotating type which mixes the fibres homogenously in a randomly oriented distribution throughout the sand.

The random dispersion cf fibres reinforces the sand imparting resistance to particle movement under load from the horses hooves etc. thus minimizing spreading and hoof penetration such that a sure footing is obtained. This effect is obtained under both wet or dry conditions.

The fibre lengths require to be long enough such that a "cross-linking" effect is produced thereby preventing the sand from moving under the pressure of the horses hooves or players feet or other users such as wheeled vehicles or implements.

Thus the particle size of the sand and the diameter and length of the fibres requires to be carefully selected to produce the desired effect.

Relatively straight (i.e. uncrimped) fibres need to be used since crimped fibres are not readily mixed to produce a substantially "homogenous" mixture. The length of the fibres is of particular importance since this provides, in the homogenous mixture, the cross-linking which is necessary to prevent the mixture from spreading under the shock loading produced by horses hooves or players feet or other users such as wheeled vehicles or implements.

Following mixing in the contra rotating high intensity or other high intensity type mixer the mixture is delivered to the prepared site and laid out to a depth of between 5 to 15 cm (2 to 6 inches) or more preferably 7.5 to 12.5 cm to give the desired surface characteristic.

The characteristic of the surface can be altered by the choice of sand particle size and the percentage of fibre mixed into the sand.

Further drainage may be obtained in the normal manner by providing a layer of gravel beneath the sand layer.

What I claim is:

1. An all weather surface for equestrian events or sports events comprising a layer of material laid on top of a prepared drainage base, the material comprising a mixture of sand and synthetic fibres, the fibres being randomly dispersed as separate individual fibres throughout the sand to produce a relatively soft surface.

2. An all weather surface as claimed in claim 1 in which the sand particles are in the range from 100 to 1000 um and the fibres are in the range from 25 to 75 mm in length.

3. An all weather surface as claimed in claim 2 in which the fibre length is between 35 and 50 mm.

4. An all weather surface as claimed in Claim 1 in which the layer is between 75 mm and 150 mm and in which the diameter of fibres is 50 to 150 denier.

5. An all weather surface as claimed in claim 4 in which the preferred diameter is in the region of 100 denier and the depth of layer is in the region of 100 mm.

6. An all weather surface as claimed in claim 1 in which the fibres are of any polymeric material.

7. An all weather surface as claimed in claim 6 in which the fibres are polypropylene in an uncrimped form commonly referred to as straight staple fibre.

8. An all weather surface as claimed in claim 7 in which the percentage of fibre in the mixture is in the region of 0.1 to 0.9% by weight.

9. An all weather surface as claimed in claim 8 in which the percentage of fibre is 0.45% by weight.

10. An all weather surface as claimed in claim 8 in which the range of percentage weight of fibre to sand is 0.4 to 0.5%.

11. An all weather surface as claimed in claim 1 in which the sand is silica sand.

12. An all weather surface as claimed in claim 1 in which the sand is a sand bonded with water activated clay.

13. An all weather surface as claimed in claim 1 in which the sand is a sand bonded with an organic liquid activated clay.

14. An all weather surface as claimed in claim 11 in which the percentage of fibres is in the range from 0.3 to 0.6% by weight.

15. An all weather surface as claimed in claim 12 in which the percentage of fibres is in the range from 0.2 to 0.5%.

16. An all weather surface as claimed in claim 13 in which the percentage of fibres is in the range from 0.1 to 0.4% by weight.

17. An all weather surface as claimed in claim 1 in which the fibres are coloured to conform to the colour of the sand thereby being substantially invisible in use.

18. A sand mixture for forming an equestrian riding surface the mixture comprising a selected sand containing a small percentage by weight of elongate fibres the fibres being homogenously mixed into the sand in a high intensity mixer and in which the elongate fibres are of a polymeric material and are in an uncrimped form.

19. An all weather surface for equestrian events or sports events comprising a layer of material laid on top of a prepared drainage base, the material comprising a mixture of sand and polymeric fibres, the fibres being randomly dispersed as separate individual fibres throughout the sand to produce a relatively soft surface; the sand being bonded with liquid activated clay and having particle size of 100 to 1000 um; the fibres being in the range of 25 to 75 mm in length and having a diameter of between 50–150 denier; the percentage of fibres in the mixture being in the region of 0.1 to 0.9% by weights and the depth of said layer of material 75 mm to 150 mm.

20. An all weather surface as claimed in claim 21 in which the sand is silica and is bonded with an organic liquid activated clay; and said fibres are polypropylene in an uncrimped form and the percentage of fibre is 0.45% by weight.

* * * * *

UNITED STATES PATENT AND TRADEMARK OFFICE

CERTIFICATE OF CORRECTION

PATENT NO. : 4,819,933

DATED : April 11, 1989

INVENTOR(S) : Victor J. Armand

It is certified that error appears in the above-identified patent and that said Letters Patent is hereby corrected as shown below:

Column 6, line 32 delete "21" and insert --19--.

Signed and Sealed this

Second Day of January, 1990

*Attest:*

JEFFREY M. SAMUELS

*Attesting Officer*

*Acting Commissioner of Patents and Trademarks*